US006363896B1

(12) United States Patent
Speier

(10) Patent No.: US 6,363,896 B1
(45) Date of Patent: Apr. 2, 2002

(54) CAMSHAFT ADJUSTER FOR INTERNAL COMBUSTION ENGINES

(75) Inventor: Wolfgang Speier, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/673,772

(22) PCT Filed: Apr. 14, 1999

(86) PCT No.: PCT/EP99/02495

§ 371 Date: Jul. 5, 2001

§ 102(e) Date: Jul. 5, 2001

(87) PCT Pub. No.: WO99/54599

PCT Pub. Date: Oct. 28, 1999

(30) Foreign Application Priority Data

Apr. 18, 1998 (DE) ..... 198 17 319

(51) Int. Cl.[7] ..... F01L 1/344

(52) U.S. Cl. ..... 123/90.17; 74/568 R

(58) Field of Search ..... 123/90.15, 90.17, 123/90.31; 74/568 R; 464/1, 2, 160

(56) References Cited

U.S. PATENT DOCUMENTS

| | | | | |
|---|---|---|---|---|
| 4,091,776 A | | 5/1978 | Clemens et al. | 123/90.15 |
| 5,088,456 A | * | 2/1992 | Suga | 123/90.17 |
| 5,450,825 A | * | 9/1995 | Geyer et al. | 123/90.17 |

FOREIGN PATENT DOCUMENTS

| | | |
|---|---|---|
| DE | 40 29 849 | 3/1991 |
| DE | 39 37 644 | 5/1991 |
| DE | 196 11 365 | 9/1997 |
| DE | 197 26 300 | 1/1998 |
| WO | 92/20906 | 11/1992 |

* cited by examiner

*Primary Examiner*—Weilun Lo
(74) *Attorney, Agent, or Firm*—Kenyon & Kenyon

(57) ABSTRACT

A camshaft adjuster (1) for internal combustion engines has a central tensioning screw (9) for fixing the adjuster (1) in relation to a camshaft (2). A slide (8) controls the supply of the pressure medium to the camshaft adjuster (1) being integrated into the tensioning screw (9). The tensioning screw (9) forms the mounting of the camshaft adjuster (1) in relation to the camshaft (2).

4 Claims, 3 Drawing Sheets

CAMSHAFT ADJUSTER FOR INTERNAL COMBUSTION ENGINES

CROSS-REFERENCE TO RELATED APPLICATIONS

This application is the national phase filing of PCT/EP99/02495 filed Apr. 14, 1999, which claims priority to German Patent Application 198 17 319.9 filed Apr. 18, 1998, which applications are herein expressly incorporated by reference.

BACKGROUND OF THE INVENTION

The invention relates to a camshaft adjuster for internal combustion engines.

Camshaft adjusters are known in the form of piston-type adjusters with an axially displaceable piston (DE 40 29 849 C2, DE 196 11 365 A1 and DE 197 26 300 A1) and in the form of vane-type adjusters with vanes that can be acted upon and pivoted in the circumferential direction. In connection with both designs, the camshaft adjuster is fixed as an end-mounted extension of the camshaft by means of a central clamping screw.

For the purpose of controlling the hydraulic pressure supply to the camshaft adjuster, DE 40 29 849 C2 discloses the provision of an external 4/2-way valve, from which supply passages run to the camshaft and to the actuating piston that is provided here as the actuating means and is arranged in an accommodation space between the inner element and the outer element, the drive connection to the crankshaft running via the outer element.

The long conduit paths that this entails, with the risk of corresponding leaks and of a certain elasticity, can have the effect that the system has inadequate hydraulic rigidity and thus makes satisfactory control more difficult, not to mention the fact that the external arrangement of the control device formed by the directional control valve has a negative effect in terms of the outlay on construction and the size of the installation space required.

DE 196 11 365 A1 discloses integration of the control device designed as a multi-way valve into the clamping screw. The result is that the latter acts as a housing to form an axial receptacle for a centrally situated and axially displaceable control spool via which pressure medium can be supplied to the actuating means radially along short paths.

In view of this, provision is made to guide the camshaft adjuster's inner element, which is fixed in terms of rotation relative to the camshaft, the camshaft adjuster's outer element, which can be turned relative to the inner element and via which the drive connection to the crankshaft runs, on the clamping screw, irrespective of centering of the inner element relative to the camshaft independently of this. This requires very narrow tolerances, that is to say a high outlay on manufacture, and furthermore leads to misalignment errors due to the cumulative effect of a number of radial guides subject to play, these errors potentially having disadvantageous effects on concentricity of running and vibration, such concentricity and misalignment errors also make it more difficult to operate the control spool by means of the axially offset actuating magnet as actuator, associated with the spool on the housing side, with the minimum clearance relative to the armature carried by the control spool. However, larger clearances lead to a need for more power and hence for more space, and, given the conditions of construction in the case of internal combustion engines for motor vehicles, this is often not available, if only because of the axial extension entailed by the camshaft adjuster.

SUMMARY OF THE INVENTION

The object of the present invention is to construct a camshaft adjuster of the type stated at the outset in such a way that optimum centering of the camshaft adjuster is achieved. This centering simultaneously creates the conditions for particularly simple and economical manufacture.

According to the invention, this is achieved by the clamping screw forming the element of the camshaft adjuster that effects centering relative to the camshaft, eliminating the need to provide the adjuster with any further centering support as regards its inner and outer element and its lateral closure elements in the form of covers. This eliminates the need for axial undercuts or projections on the inner and outer elements, which would make manufacture more difficult. Moreover, the configuration according to the invention, involving centering of the entire camshaft adjuster, including the connection of the control device formed by the multi-way valve to the actuator, by means of the clamping screw, creates particularly favorable conditions for largely tolerance-free centering without excessive demands as to manufacture, with ideal conditions for optimum, vibration-free concentricity of running and with the minimum required clearances at the transition between the control spool and the actuator.

As a refinement of the invention, the inner element and the outer element can be designed with flat end faces, that is to say form disc-shaped elements, which are covered over a certain area by annular covers, with the result that the covers require only axial clamping. It has proven expedient here if the covers adjoin the centering collar of the camshaft radially on the inside, providing sufficient radial overlap with the inner and outer elements to allow the use of simple sealing means in so far as these are to be used, the precise centering with small clearances achieved by means of the invention also having an advantageous effect as regards the reduction of leakage.

The refinement according to the invention of using disc-shaped inner and outer elements and covers leads to particularly far-reaching simplifications in the case of camshaft adjusters designed as vane-type adjusters.

From the following detailed description, taken in conjunction with the drawings and subjoined claims, other objects and advantages of the present invention will become apparent to those skilled in the art.

BRIEF DESCRIPTION OF THE DRAWINGS

Further details and features of the invention will become apparent from the claims. The invention will furthermore be explained with additional details by means of the drawings in which:

DETAILED DESCRIPTION OF THE PREFERRED EMBODIMENT

Figure 1:
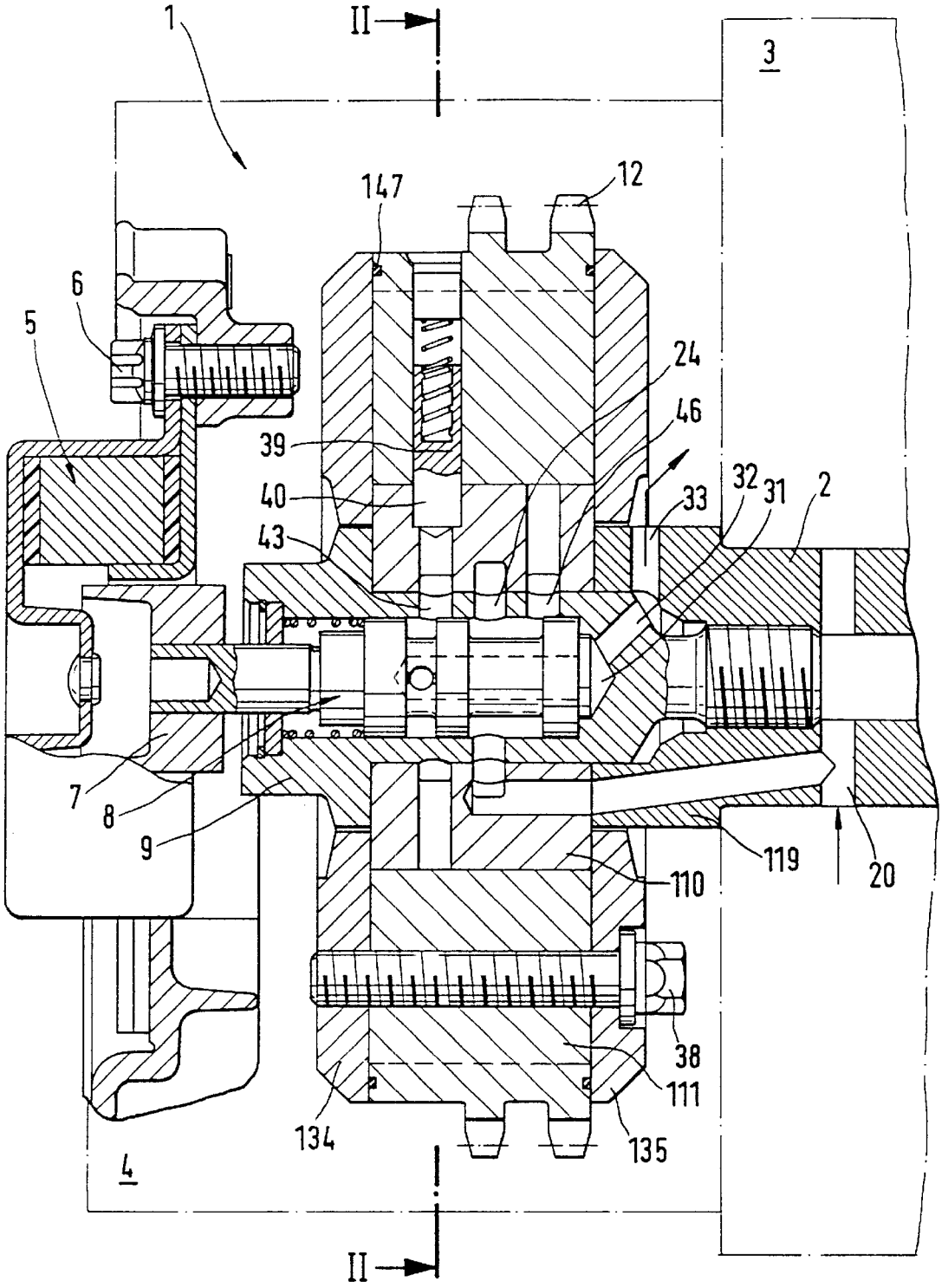
FIG. 1 is a partially schematic longitudinal section view through a camshaft adjuster according to the invention, along the line I—I in FIG. 2.
Figure 2:
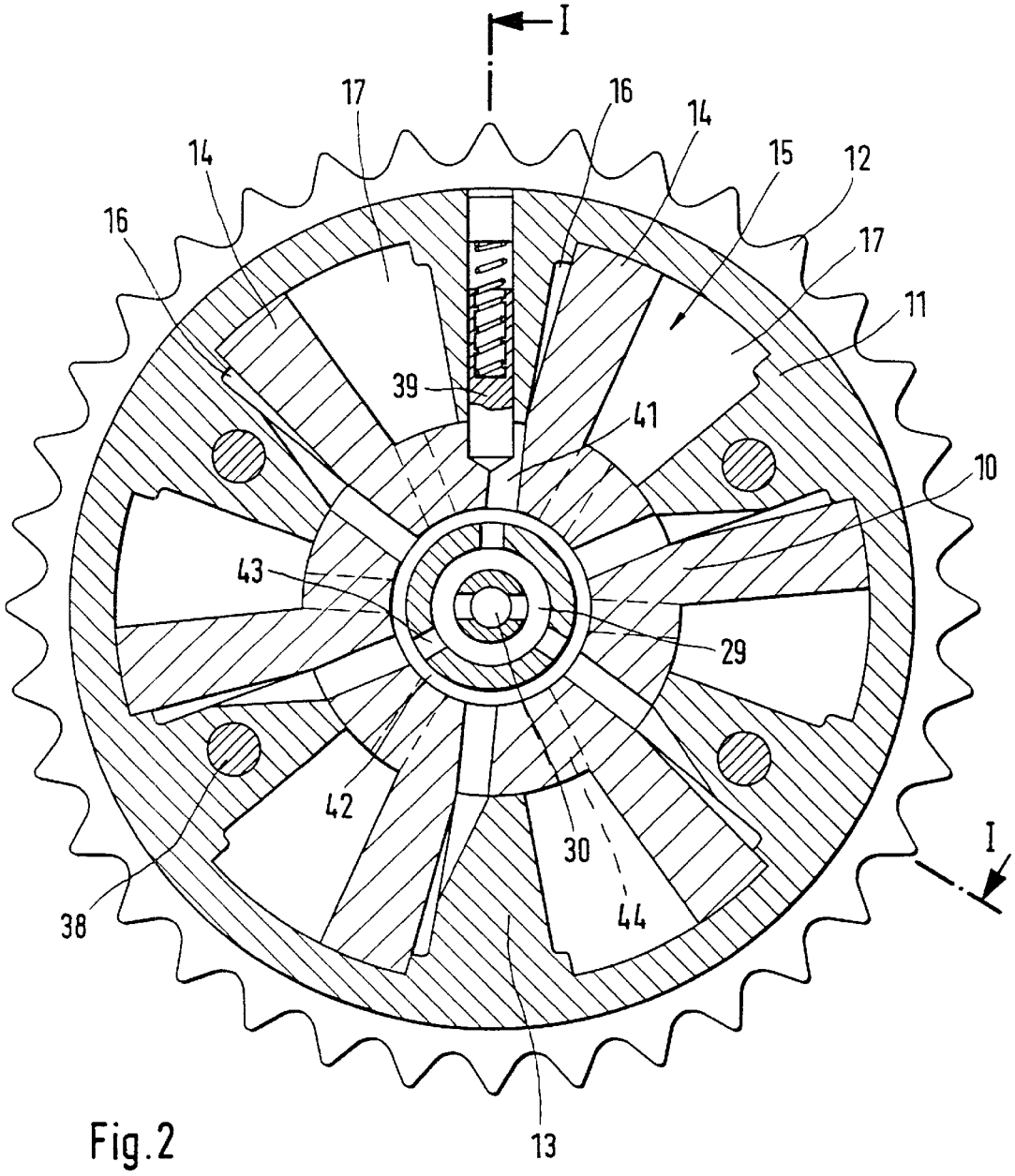
FIG. 2 is a section view along line II—II in FIG. 1.
Figure 3:
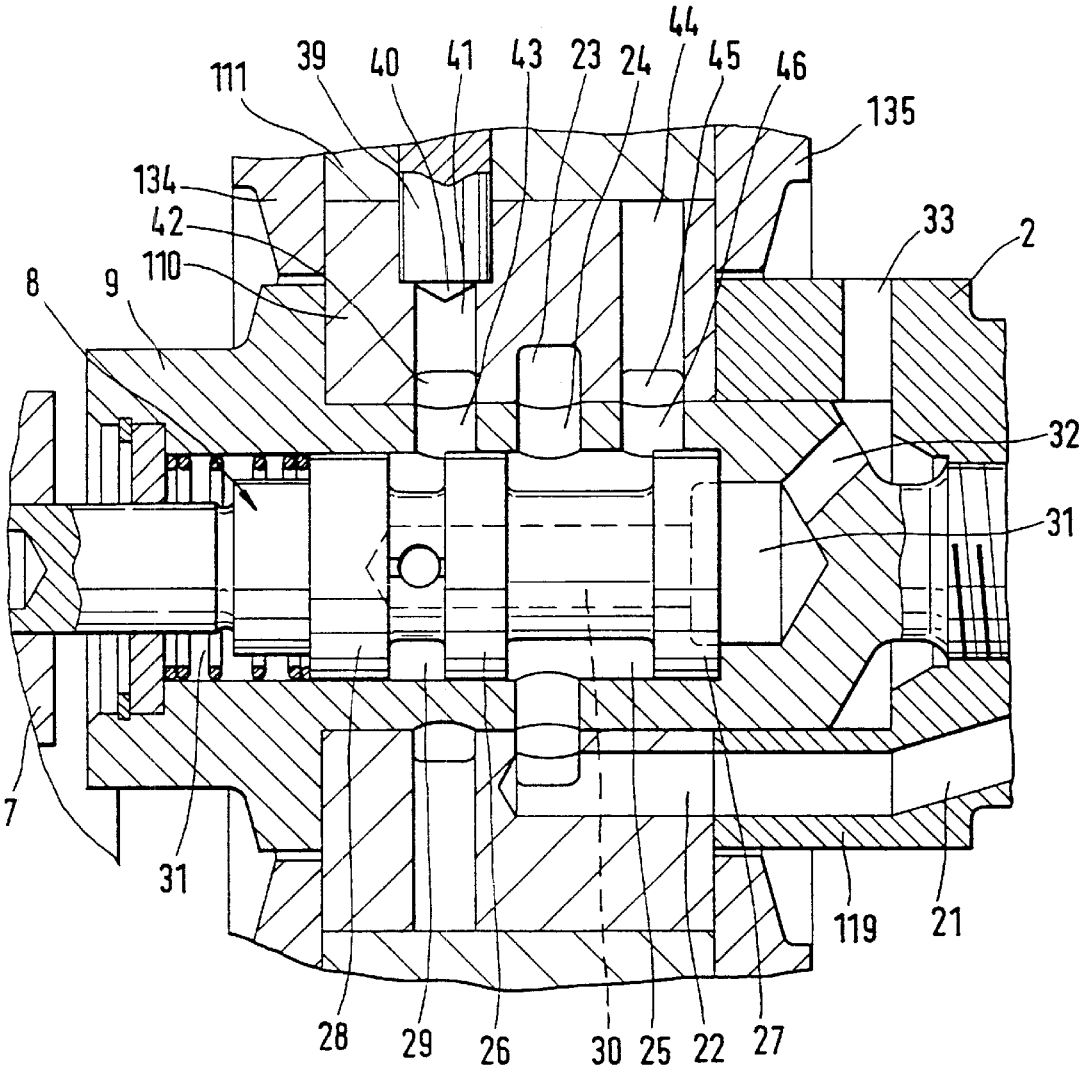
FIG. 3 is a view substantially similar enlarged representation of the central area of the camshaft adjuster shown in FIG. 1.

The camshaft adjuster shown in FIGS. 1 to 3 is denoted overall by the numeral 1 and is shown in association with a camshaft 2 of an internal combustion engine 3, which is shown here only in outline and on the end of which that is associated with the illustrated end of the camshaft 2 a chain case 4 (shown essentially only in outline) is provided. Provided on this chain case 4, as an axial extension of the camshaft 2 and situated opposite the latter, is the actuator 5 associated with the camshaft adjuster 1. The actuator is formed by an actuating magnet and is bolted onto the outside of that end of the chain case 4 which is remote from the internal combustion engine 3, as indicated at 6.

The actuator 5 formed by an actuating magnet interacts with the armature 7 of a control spool 8, which is integrated into a central screw in the form of a clamping screw 9, by means of which the camshaft adjuster 1 is flanged onto the end of the camshaft 2, the clamping screw 9, the control spool 8 of the camshaft adjuster 1 and the actuator 5 being coaxial with the camshaft 2.

Seated on the clamping screw 9 and clamped axially against the camshaft 2 is the inner element 110 of the camshaft adjuster 1 and associated with it is an outer element 111, which has teeth 12 on its outer circumference, by means of which the camshaft 2 is driven by the crankshaft (not shown here) of the internal combustion engine 3 in a fixed relationship with respect to direction and speed of rotation. The chain drive discussed and indicated here could, of course, also be replaced by other types of drive connection, such as toothed-belt drives or gear mechanisms.

Distributed over its circumference, the outer element 111 has piston vanes 13, associated with which on the inner element 110 are mating vanes 14, respective pairs of mating vanes 14 delimiting a ring sector 15 in which a piston vane 13 of the outer element 111 is located, the outer element 111 forming, with the piston vanes 13 associated with it, as it were a vaned rotor which can be adjusted relative to the inner element 110 over an angular range limited by the mating vanes 14 of a ring sector 15.

Within each ring sector 15, the piston vanes 13 and the mating vanes 14 delimit two working chambers 16, 17 that can be pressurized hydraulically, more specifically under the control of the control spool 8.

From FIGS. 1 and 3, it can be seen that the clamping screw 9 is centered relative to the camshaft 2 by means of a centering collar 119 on the camshaft 2. The centering collar 119 is supported directly on the circumference of the clamping screw 9. This centering of the clamping screw 9 and the camshaft 2 relative to one another in the region of the end adjacent to the camshaft 2 makes it possible to construct the inner element 110 and the outer element 111 as flat discs. The result is that these have ends that lie in planes perpendicular to the axis of the camshaft 2 and can be covered by likewise flat covers 134, 135 designed as annular covers. In conjunction with the axial clamping of the clamping screw 9 relative to the camshaft 2, the centering collar 119 interacting with the circumference of the clamping screw 9 thus allows direct alignment of the clamping screw 9 on the camshaft 2, resulting in simplicity of manufacture and easily manageable production of the camshaft adjuster 1 in terms of fitting clearances. This applies especially also to the inner element 110 and the outer element 111 and to the annular covers 134, 135 covering the latter axially, since these components can all be constructed as flat discs, at least as regards the interacting surfaces, which allows narrow tolerances in combination with simplicity of manufacture. This likewise makes it possible, where appropriate, to clamp the covers 134, 135 against the inner element 110 and the outer element 111 without seals, although seals can be incorporated into the interacting surfaces as annular seals without any great outlay in such a solution, as indicated at 147. In general, however, such seals are also superfluous because the working pressures are relatively low and, even without seals, leaks within the scope of the fine machining possible with surface grinding are limited to a level that can be accepted if the camshaft adjuster 1 is arranged in the chain case 4.

Pressure medium is fed to the respective working chamber 16 or 17 in a manner not shown specifically via a bearing location of the camshaft 2 in the housing of the internal combustion engine and radial holes 20 in the camshaft 2. From there, an axial passage 21, 22 leads via the camshaft 2 and the inner element 110 to an annular space 23 in the inner element 110, this annular space overlapping with radial holes 24 in the clamping screw 9. These holes open into an annular space 25 in the control spool 8. The annular space is situated between annular collars 26, 27 on the control spool 8 which delimit the annular space 25 axially.

Together with a further annular collar 28 offset in a direction away from the camshaft 2, the annular collar 26 remote from the camshaft 2 delimits another annular space 29, which is connected by a radial connecting hole and an axial hole 30 to the receptacle 31, which opens into the chain case 4 via a hole 32, the latter passing through the bottom end of the receptacle 31, and a radial connecting passage 33 that passes through the centering collar 119 of the camshaft 2.

The ring sectors containing the working chambers 16 and 17 are closed off axially by the annular covers 134 and 135, which cover areas of the end faces of the inner element 110 and the outer element 111 and are held against the flat end faces of the inner element 110 and the outer element 111 by axial clamping screws 38.

To fix the outer element 111 as a vaned rotor in its position corresponding to the starting position of the internal combustion engine, this generally 10 corresponding to a retarded position of the camshaft 2, a locking element 39 in the form of a radial pin is provided in the region of one piston vane 13 of the outer element 111. The radial pin is spring-loaded towards the inner element 110 and has associated with it a latching opening 40 in the inner element 110. The latching opening 40 overlaps with a radial passage 41, which starts from an annular groove 42 provided in the inner circumference of the inner element 110 and opens into the chamber 16. This annular groove 42 overlaps with radial holes 43 in the axial wall of the clamping screw 9. The axial wall forms the guide for the control spool 8 and delimits the receptacle 31 for the control spool 8. Radial passages 44 (illustrated in broken lines in FIG. 2) are provided in the inner element 110. These are offset axially relative to the illustration in FIG. 1 and open into the other working chamber 17. The radial passages 44 open into annular grooves 45 that overlap with radial holes 46 in the wall of the clamping screw 9.

When the internal combustion engine 3 is started, pressure medium is supplied via the radial hole 20 in the camshaft 2 and passes via the axial passages 21 and 22 into the annular space 25 of the control spool 8. In accordance with the starting position, the spool initially assumes a spring-loaded end position adjacent to the camshaft 2 until, with the performance of the starting operation, the actuator 5 is activated and the armature 7 is attracted by the actuating magnet, with the result that the annular space 25 is moved into overlap with the radial hole 43 in the clamping screw 9 and, via the annular groove 42, with the radial passage 41, and hence supplies the locking element 39 and the chamber 16 with pressure medium. The locking element 39 is thereby displaced counter to the spring force. The locking provided by the locking element 39 is cancelled. The outer element 111 is pivoted counter-clockwise (in relation to the illustration in FIG. 2) in the direction of an advanced position of the camshaft 2.

Once the desired camshaft position has been reached by appropriate control of the control magnet of the actuator 5, as a function of the control of the engine, the annular collars 26 and 27 of the control spool 8 are moved into overlap with the holes 43 and 46, thus interrupting the supply of pressure medium to the chambers 16 and 17 as long as the camshaft is in its intended position. If displacement occurs relative to this position, owing to leaks for example, the necessary adjustment is performed by means of the actuating magnet 5, which is adjusted accordingly, operating as a continuous control element, e.g. as a proportional magnet, that is by supplying or releasing pressure medium to or from one of the chambers 16 and 17.

If the internal combustion engine 3 is switched off, the control spool 8 moves back into the initial position. Here, the chamber 16 is connected to the return by the annular space 29. Thus, the chamber 16 is emptied and simultaneously allows the pin forming the locking element 39 to be pushed back into its locking position by the spring force. In both end positions of the control spool 8, the particular chamber that is not pressurized is open to the return.

The configuration indicated provides a camshaft adjuster 1 which is very short in the axial direction of the camshaft 2. The inner element 110 is clamped axially against the camshaft 2 and at the same time, centered by the clamping screw 9, the clamping screw 9, for its part, simultaneously forms the centering means for the inner element 110.

While the above detailed description describes the preferred embodiment of the present invention, the invention is susceptible to modification, variation and alteration without deviating from the scope and fair meaning of the subjoined claims.

What is claimed is:

1. A camshaft adjuster for internal combustion engines, which is situated in the drive for driving a camshaft by means of the crankshaft and is to be connected to the camshaft in a centered and coaxial manner with respect to the latter, comprising:

an inner element which is fixed in terms of rotation relative to the camshaft is penetrated by a central clamping screw and can be clamped axially against the camshaft by means of this screw;

an outer element which can be turned relative to the inner element and via which the drive connection to the crankshaft runs;

an accommodation space between the inner element and the outer element for hydraulically pressurizable actuating means for turning the outer element relative to the inner element; and a control device associated with these actuating means and having a multi-way valve integrated into the clamping screw, which, as a housing, forms an axial receptacle for a centrally situated and axially displaceable control spool, the clamping screw carrying the inner element engages by its camshaft end in an axial centering collar on the camshaft and is supported against the latter.

2. The camshaft adjuster according to claim 1, wherein the inner element and the outer element are designed with flat end faces and are covered over a certain area by annular covers.

3. The camshaft adjuster according to claim 2, wherein the annular covers adjoin the centering collar of the camshaft radially on the inside.

4. The camshaft adjuster according to claim 1, wherein the control spool is connected to the armature of an actuator arranged fixed relative to the housing and comprising an actuating magnet.

* * * * *